US005086738A

United States Patent [19]

Kubis et al.

[11] Patent Number: 5,086,738

[45] Date of Patent: Feb. 11, 1992

[54] MOTOR BRAKE FOR AIR-COMPRESSING INTERNAL COMBUSTION ENGINES

[75] Inventors: Heribert Kubis; Dieter Wittmann, both of Nuremberg, Fed. Rep. of Germany

[73] Assignee: MAN Nutzfahrzeuge Aktiengesellschaft, Munich, Fed. Rep. of Germany

[21] Appl. No.: 667,050

[22] Filed: Mar. 8, 1991

[30] Foreign Application Priority Data

Mar. 8, 1990 [DE] Fed. Rep. of Germany ..... 4007287

[51] Int. Cl.[5] ..... F01L 13/06; F02D 9/06; F02D 13/04

[52] U.S. Cl. ..... 123/322; 123/323; 123/90.16; 123/90.56

[58] Field of Search ..... 123/322, 321, 323, 90.16, 123/90.56

[56] References Cited

U.S. PATENT DOCUMENTS

| | | | |
|---|---|---|---|
| 3,786,792 | 1/1974 | Pelizzoni et al. | 123/321 |
| 4,333,430 | 6/1982 | Rosquist | 123/321 |
| 4,572,114 | 2/1986 | Sickler | 123/321 |
| 4,592,319 | 6/1986 | Meistrick | 123/321 |
| 4,662,332 | 5/1987 | Bergmann et al. | 123/321 |
| 4,796,573 | 1/1989 | Wakeman et al. | 123/90.56 |

FOREIGN PATENT DOCUMENTS

| | | |
|---|---|---|
| 3026529 | 2/1982 | Fed. Rep. of Germany . |
| 3300763 | 7/1990 | Fed. Rep. of Germany . |

OTHER PUBLICATIONS

German Patent Application SN P 39 39 934.6, filed 2 Dec. 1989, U.S. Ser. No. 621,311 filed 30 Nov. 1990).

*Primary Examiner*—Andrew M. Dolinar

*Attorney, Agent, or Firm*—Robert W. Becker & Associates

[57] ABSTRACT

A motor brake for an air-compressing internal combustion engine is provided. A hydraulic linkage system is disposed between a cam and an exhaust valve, and communicates via a connecting line with a high-speed solenoid valve and a linkage oil compensating system of an engine lubricating-oil circuit. A control valve is disposed in an exhaust manifold of the engine and upon actuation of the motor brake partially closes off the exhaust manifold along with activation of the solenoid valve. Via the interposition of a control unit, signals of at least one sensor are conveyed to a solenoid of the solenoid valve in such a way that, upon actuation of the motor brake during a specific time interval during lifting of a valve tappet via a projection of the cam in a compression phase, the solenoid valve is closed. The time interval is derived via processing of signals of the sensor formed from the cam position and camshaft speed. The cam is divided into six sectors having a first angular range for opening the exhaust valve in an exhaust phase, a second angular range for filling a cylinder space of the valve tappet, a third angular range for initiating closure of the solenoid valve, a fourth angular range for the cam projection, a fifth angular range for reopening the solenoid valve, and a sixth angular range for emptying the cylinder space.

4 Claims, 2 Drawing Sheets 1
3
3
7b
8
17
18
6
15
16
14
7a
S
11
12
24
19
25
21
20
22
23
9
4
5
10
2
2a
2b
h
13

MOTOR BRAKE FOR AIR-COMPRESSING INTERNAL COMBUSTION ENGINES

BACKGROUND OF THE INVENTION

The present invention relates to a motor brake for an air-compressing internal combustion engine, and includes a hydraulic linkage system disposed between a cam and an exhaust valve, with the hydraulic linkage system communicating via a connecting line with an external regulating mechanism and a leakage oil compensation means of an engine lubricating-oil circuit, and with a butterfly or control valve means being provided that is disposed in an exhaust manifold of the engine and that upon actuation of the motor brake partially closes off the exhaust manifold along with activation of the regulating mechanism.

DE-OS 30 26 529 discloses a motor brake of this general type where a hydraulic linkage system is provided between a cam and a push rod of an exhaust valve of an air-compressing internal combustion engine. The hydraulic linkage system comprises a valve tappet that at the same time is embodied as a cylinder. This cylinder accommodates a piston that cooperates with the push rod. The cylinder space between the piston and the cylinder communicates with a regulating mechanism that is in the form of a piston pump and can, for example, be driven by a cam shaft. The stroke of the piston in the cylinder is limited in such a way that when the valve tappet rests upon the base circle of the cam, and by imparting a pressure from the piston pump, the exhaust valve just opens far enough that in the motor braking operation, during the compression phase, air is released. During the normal exhaust phase, there is no pressure in the cylinder space and the exhaust valve is opened merely by having the tappet run up on a cam. Since there is no pressure on the cylinder space during the exhaust phase, the force of the valve tappet is transferred directly to the push rod by having the piston strike the base of the cylinder. In order to be able to compensate for leakage oil losses of the hydraulic linkage system, the cylinder can be connected with a lubricating-oil circuit via a relief valve.

Such an operation of the exhaust valve has the drawback that the piston pump that is required for this purpose is relatively expensive and is subject to wear. Due to the complicated construction, the mechanism is also susceptible to problems.

DE-OS 33 00 763 proposes connecting the cylinder space of the piston, which cooperates with the cam shaft, to a controllable valve via a line, so that the transfer of the movement of the piston to a valve piston can be interrupted whenever desired. To replenish leakage oil-loses, the hydraulic linkage system can again be connected to the lubricating-oil circuit via a relief valve. A hydraulic linkage system of this type requires a large amount of space, since the cylinder and piston do not form a particularly compact unit. The shortcoming of this unit is that a connecting line, even if it is only a short one, is required between the cylinder spaces; this gives rise to a long time lag.

German Patent Application P 39 39 934 proposes disposing a hydraulic linkage system between a camshaft and an exhaust valve, with the camshaft having two projections. A first projection serves in the customary manner for opening the exhaust valve in the exhaust phase. A second projection can also lift the exhaust valve in the compression phase in order via a pressure-regulating effect to perform braking work. The switch-over from normal operation to braking operation is effected by activating a lifting magnet that branches off from a connecting line of the pistons of the hydraulic linkage system. During the time interval in which the lifting magnet is closed, the second projection of the cam can transmit its movement to the exhaust valve, so that this valve can also be lifted somewhat during the compression phase and via exhaust work can perform braking work. Leakage oil loses are replaced from the lubricating-oil circuit via a relief valve. Due to the fact that the piston that is actuated by the cam, and the piston of the exhaust valve, are separated from one another and are connected via a longer line, this valve actuation has a somewhat complicated structure. Furthermore, due to the long connecting line, the valve operation becomes sluggish, i.e. has a time lag, which restricts its use in high speed engines.

Starting with a motor brake of the aforementioned type, it is an object of the present invention to eliminate the pump, which is expensive and susceptible to problems, and to make the control of the exhaust valve during the braking operation more flexible via a modern electronic mechanism.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
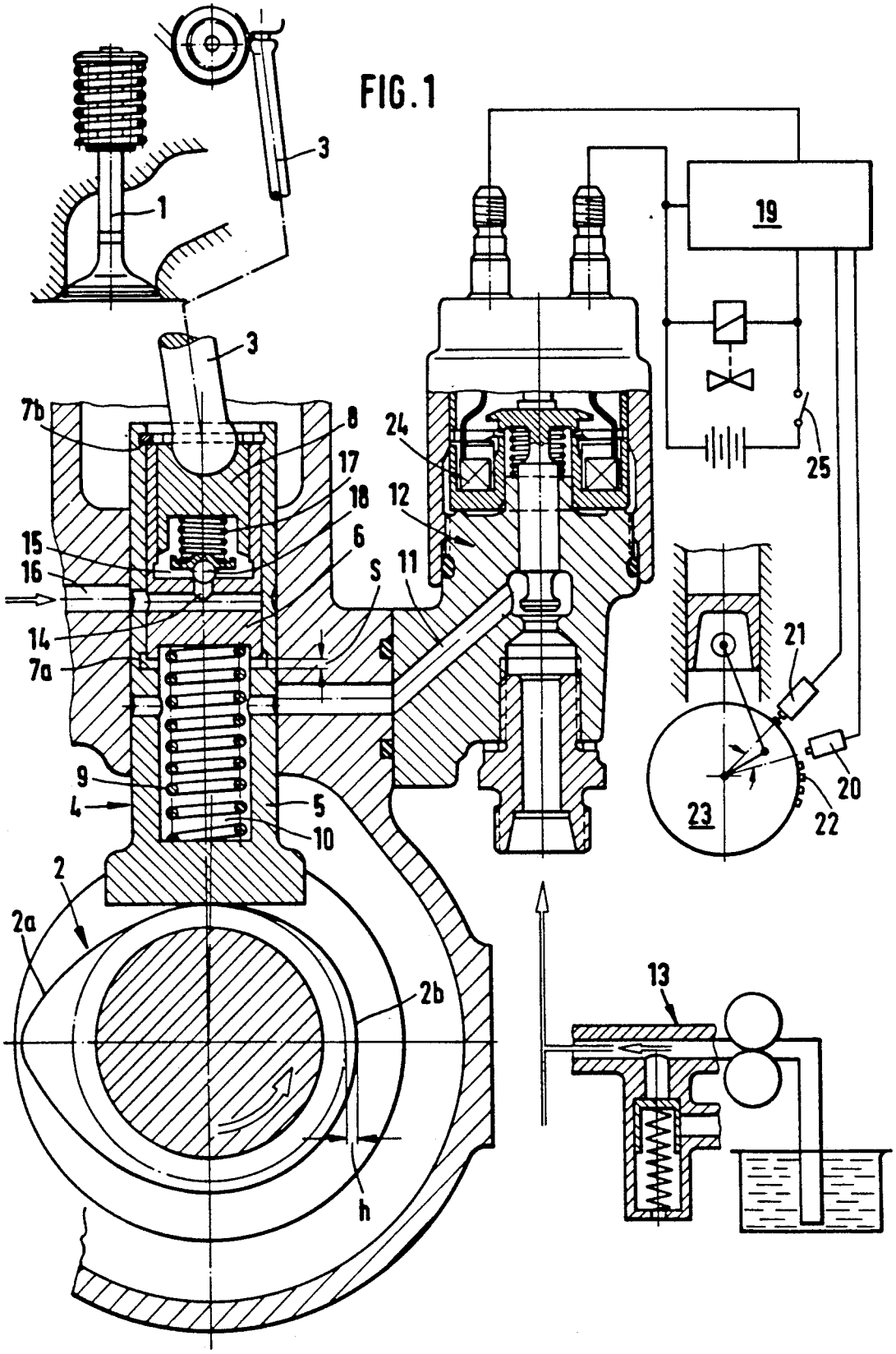
FIG. 1 is a cross-sectional view through a hydraulic linkage system with the solenoid valve connected in parallel, of one exemplary embodiment of the inventive motor brake.

The motor brake of the present invention is characterized primarily in that the regulating mechanism is embodied as a high-speed solenoid valve that can be activated by at least one sensor, with the signals of this sensor, accompanied by the interposition of a control unit, being conveyed to a solenoid of the solenoid valve in such a way that upon actuation of the motor brake during a specific time interval during lifting of a valve tappet of the hydraulic linkage system via a secondary projection of the cam in the compression phase of the engine, the solenoid valve is closed, with the time interval being derived via a processing, in the control unit, of signals of the sensor formed from the cam position and the camshaft speed, whereby the cam is divided into six sectors, with a first sector having a first angular range that serves, via a primary projection of the cam, for opening of the exhaust valve in an exhaust phase, a second sector having a second annular range that serves for filling a cylinder space of the valve tappet, a third sector having a third angular range that initiates closure of the solenoid valve, a fourth sector having a fourth angular range that is provided with the secondary cam projection, a fifth sector having a fifth angular range that serves for the opening of the solenoid valve, and a sixth sector having a sixth angular range that serves for the emptying of the cylinder space of the valve tappet.

A particular advantage of the inventive motor brake over the state of the art is primarily that the otherwise necessary hydraulic pump unit that is driven by the camshaft and is provided for achieving the complimentary lifting of the exhaust valve in the compression stroke is eliminated. With the inventive motor brake the supplemental lifting, which is approximately the same with regard to lifting characteristic and opening time, is achieved by an altered exhaust cam shape and an electronic control via "high-speed" solenoid valves, a respective one of which is associated with each exhaust tappet.

In contrast to the regulating mechanism provided via a hydraulic pump unit, the inventive electronic regulating mechanism is advantageous to use due to the fact that high-speed solenoid valves, due to the widely accepted use of electronic mechanisms, are now also economically produced in the engine manufacturing industry and operate reliably. To establish the control current pulses, the control mechanisms and power/current distributors that are required anyway for mass-produced, fully-electronic Diesel engine regulation can be appropriately adapted, so that for this purpose no significant additional costs result. Further advantages over control via a hydraulic pump unit include simplification via a smaller number of movable parts, the possibility of eliminating external high-pressure lines, and a greater flexibility with regard to design of the exhaust control times during the supplemental lifting.

Pursuant to one further specific embodiment of the present invention, the hydraulic linkage system is provided with a hydraulically operating valve play compensation means that is formed from a compensating piston that is coaxially disposed in the piston of said hydraulic linkage system, with this compensating piston being disposed between the piston of the linkage system and the push rod of the exhaust valve; a cylinder space defined between the piston of the linkage system and the compensating piston can communicate with the engine lubricating system via a bore that can be blocked via a spring-loaded valve.

Such a hydraulic valve play compensating means ensures that even upon pounding of the seat of the exhaust valve or wear of the valve drive mechanism, the exact exhaust valve control times can be maintained unchanged, so that the function in both normal braking and motor braking operation is ensured regardless of the condition of wear. Due to the lack of valve play, the conventional cam ramps or inclines at the beginning and end of the cam lift for overcoming the valve play zone are no longer necessary. In this way, it is possible to make the second and sixth angular ranges large enough to provide sufficient time for the filling and emptying of the cylinder space of the valve tappet.

Pursuant to another specific embodiment of the present invention, an advantageous control for the solenoid valves is provided by disposing the sensor across from the periphery of a gear wheel or sprocket of a flywheel or across from a camshaft sprocket, with the sensor having an inductively operating base and with its voltage pulses being conveyed for processing to a control unit, which actuates the solenoid valves.

By actuating the solenoid valves via an electronically operating control unit, a flexible variation of the control times of the exhaust valve that is free of time lag is achieved.

Pursuant to a further advantageous specific embodiment of the present invention, a second solenoid valve can be provided for the sequential switching-on of the exhaust brake.

Further specific features of the present invention will be described in detail subsequently.

DESCRIPTION OF PREFERRED EMBODIMENTS

Referring now the drawings in detail, as shown in FIG. 1, in order to be able to control the operation of an exhaust valve 1, a hydraulic linkage system 4 is disposed between a cam 2 and a push rod 3. This hydraulic linkage system 4 comprises a valve tappet 5, which also assumes the function of a cylinder, and a piston 6 that is movable in an axial direction, with movement of the piston being limited by first and second abutment means 7*a* and 7*b*. Disposed in turn in the piston 6 is a compensating piston 8 that transfers the movement of the piston 6 to the push rod 3. Disposed between the piston 6 and the valve tappet 5 is a compression spring 9 that holds the piston 6 in a starting position. The cylinder space 10 defined by the valve tappet 5 and the piston 6 is connected via a short connecting line 11 with a solenoid valve 12, with the connecting line 11 in turn, when the solenoid valve 12 is opened, being in communication with an engine lubricating-oil circuit 13.

To compensate for the unavoidable wear that occurs, the compensating piston 8 can be provided in the valve drive as a hydraulically operating valve play compensating means. The compensating piston 8 is provided with a bore 14 that permits a cylinder space 15 that is defined between the piston 6 and the compensating piston 8 to communicate via a compensating line 16 with the engine lubricating-oil circuit 13. The bore 14 is closed, so that oil can be withdrawn via the compensating line 16 by means of the valve 18, which can be embodied as a sphere and is biased by a spring 17.

To control the exhaust valve 1, the cam 2 is provided with a first and second lobe or projection 2*a* and 2*b* respectively, with the first projection 2*a* effecting the normal opening of the exhaust valve 1 during the exhaust phase, and the second projection 2*b* holding the exhaust valve 1 open in the compression phase during motor braking operation.

Figure 2:
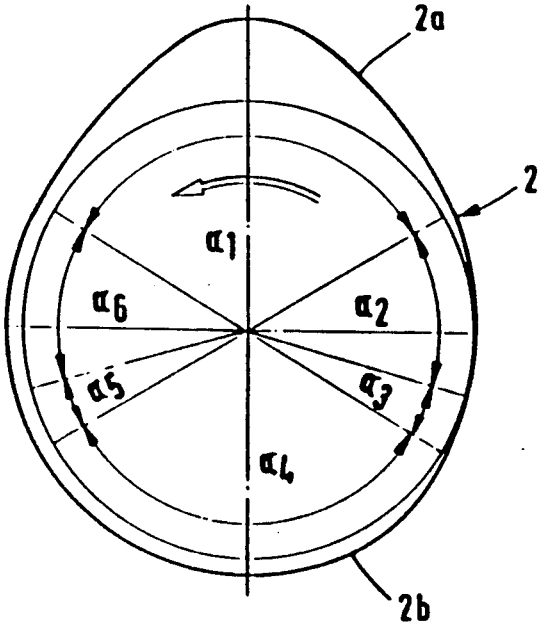
FIG. 2 shows a cam with a second projection for operating an exhaust valve in the motor braking operation.

The control of the solenoid valve 12 is assumed by a control unit 19 that operates electronically and receives its signal that is to be processed from at least one emitter, which is embodied as the sensor 20 and operates on an inductive basis. As illustrated in FIG. 1, it would of course also be possible to provide two sensors 20 and 21 or even a plurality of sensors, that are staggered at a specific angle about the periphery of a flywheel 23 that is provided with a gear wheel or sprocket 22. A camshaft sprocket could also be provided in place of the flywheel 23. The voltage pulses coming from the sensors 20 and 21 are processed in the control unit 19 in such a way that from these pulses the position of the cam 2 and its second projection 2*b* are recognized and the sectors or angular ranges $\alpha 1$ to the $\alpha 6$, which will be described subsequently in conjunction with FIG. 2, are determined. The pulses processed in the control unit 19 are conveyed to a solenoid 24 of the solenoid valve 12.

With a multi-cylinder internal combustion engine, a high-speed solenoid valve 12 is associated with each exhaust valve 1. Via the emitters 20 or 21, the control unit 19 is in a position to determine the position of all of the cams.

To initate the motor braking operation, the control unit 19 is activated by a switch 25, which can be a single or dual stage switch, so that the motor brake can be operated in a graduated manner. In a first stage, merely a pressure-regulating valve or damper in an exhaust pipe or manifold is closed; in a second stage, where greater braking power is required, the solenoid valve 12 is also activated in order to also open the exhaust valve 1 during the compression phase to such an extent that exhaust work is performed to thereby increase the braking power. It is to be understood that in order to conform to the desired braking power, the sequence of the graduated motor brake can also be reversed.

The operation of the inventive arrangement will be described in greater detail.

During operation of the engine, the solenoid valve 12 is permanently opened, and hence the electronic control is totally inactive. During the exhaust phase, the first projection 2*a* of the cam 2 lifts the valve tappet 5. Since the solenoid valve 12 is opened, no pressure can build up in the cylinder space 10. Only when the first abutment means 7*a* in the valve tappet 5 encounters the piston 6 is the movement of the valve tappet 5 transmitted to the piston 6 and, via the second abutment means 7*b*, to the push rod 3, which opens the exhaust valve 1. As the cam 2 continues to turn, the exhaust valve 1 is again closed. Although the valve tappet 5 runs up onto the second projection 2*b* of the cam 2, this has no effect since due to the fact that the solenoid valve 12 is opened, no pressure can build up in the cylinder space 10 and the stroke "h" of the tappet as a consequence of the second projection 2*b* is equal to the free distance "s" between the first abutment means 7*a* of the valve tappet 5 and the piston 6. Thus, the exhaust valve 1 is opened for the exhaust stroke only via the first projection 2*a*.

If a changeover is to be made to motor braking operation, the switch 25 is actuated, thereby activating the solenoid valve 12 via the control unit 19; during lifting of the tappet 5 via the second projection 2*b* the solenoid valve 12 is closed, so that the movement of the valve tappet 5 is hydraulically transmitted to the piston 6, which, via the interposition of the push rod 3, slightly opens the exhaust valve 1 during the compression phase, so that as a consequence of the pressure-regulating effect of the exhaust valve 1, additional braking work is performed via dissipation of the compression work. In the angular range $^{\alpha}5$ (FIG. 2.) of the second projection 2*b*, the solenoid valve 12 again opens, so that the hydraulic connection between the valve tappet 5 and the piston 6 is interrupted and the exhaust valve 1 closes, opening again only in the angular range $^{\alpha}1$. The switch 25 can also be a dual stage switch, so that in a first stage only the normal exhaust braking is actuated, and in a second stage the hydropnuematic braking is additionally actuated, or vice versa. Thus, the braking power can be graduated.

An inventive cam 2 having a second projection 2*b* is shown in FIG. 2. The cam 2 is divided into sectors or angular ranges designated by the reference symbols $^{\alpha}1$ to $^{\alpha}6$. The sector having the angular range $^{\alpha}1$ serves to open the exhaust valve 1 in the exhaust phase via the first projection 2*a*. The sector having the angular range $^{\alpha}2$ has the task of filling the cylinder space 10. The sector having the angular range $^{\alpha}3$ provides the solenoid valve 12 (FIG. 1) with time to close in the motor braking operation. The second projection 2*b* begins in the sector having the angular range $^{\alpha}4$. During this angular range $^{\alpha}4$, the solenoid valve 12 is closed and the exhaust valve 1 is open in the compression phase, so that in addition to the exhaust phase, braking work can be preformed. The sector having the angular range $^{\alpha}5$ allows the solenoid valve 12 time to open. The subsequent sector having the angular range $^{\alpha}6$ serves for the removal of oil from the cylinder space 10.

Figure 3:
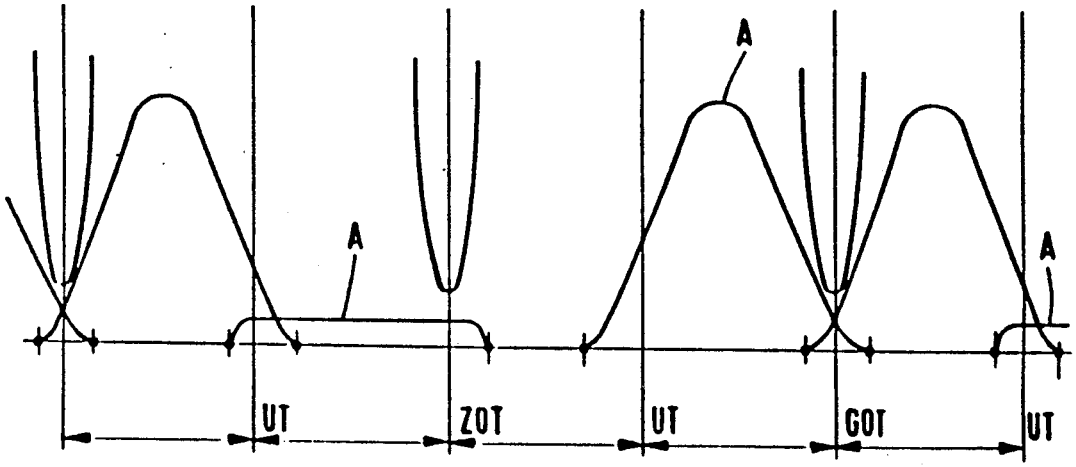
FIG. 3 is a timing diagram of an intake and exhaust valve in the motor braking operation, with the valve travel being plotted as a function of the angle of rotation of a crank-shaft.

FIG. 3 is a graph in which the piston and valve travel are plotted as a function of the crank angle. A valve opening curve of the exhaust valve is designated by the letter A. In the normal operation of the engine, the exhaust valve is open between the lower dead center position UT and a gas change GOT. During operation of the exhaust motor brake, in this phase exhaust work is performed against a pressure regulating valve in the exhaust pipe or manifold.

During additional activation of the solenoid valve 12 (FIG. 1), the exhaust valve 1 is additionally opened by the second projection 2*b* of the cam 2 between the lower dead center position UT and an ignition point ZOT, so that in this phase, via the pressure-regulating effect of the only slightly open exhaust valve 1, further exhaust work is performed and compression work is dissipated, and the braking power is increased as a supplement to the braking power of the known exhaust brake.

The present invention is, of course, in no way restricted to the specific disclosure of the specification and drawings, but also encompasses any modifications within the scope of the appended claims.

What we claim is:

1. A motor brake for an air-compressing internal combustion engine, comprising:

a hydraulic linkage system disposed between a cam and an exhaust valve;

an external regulating mechanism in the form of a high-speed solenoid valve that has a solenoid, with said linkage system communicating via a connecting line with said solenoid valve and a leakage oil compensation means of an engine lubricating-oil circuit;

a control valve means that is disposed in an exhaust manifold of said engine and that upon actuation of said motor brake partially closes off said exhaust manifold together with activation of said solenoid valve;

at least one sensor for activation of said solenoid valve; and a control unit, with signals of said at least one sensor, via the interposition of said control unit, being conveyed to said solenoid of said solenoid valve in such a way that, upon actuation of said motor brake during a specific time interval during lifting of a valve tappet of said linkage system via a secondary projection of said cam in a compression phase of said engine, said solenoid valve is closed, with said time interval being derived via a processing, in said control unit, of signals of said at least one sensor formed from a cam position and a camshaft speed, whereby said cam is divided into six sectors, with a first sector having a first angular range serving, via a primary projection of said cam, for the opening of said exhaust valve in an exhaust phase, a second sector having a second angular range serving for the filling of a cylinder space of said valve tappet, a third sector having a third angular range initiating closure of said solenoid valve, a fourth sector having a fourth angular range being provided with said secondary projection of said cam, a fifth sector having a fifth angular range serving for the reopening of said solenoid valve, and a sixth sector having a sixth angular range serving for the emptying of said cylinder space of said valve tappet.

2. A motor brake according to claim 1, wherein said hydraulic linkage system includes a hydraulically operating valve play compensating means formed by a compensating piston that is coaxially disposed in a first piston of said valve tappet of said linkage system, with said compensating piston being disposed between said first piston and a push rod that acts upon said exhaust valve; a second cylinder space defined between said first piston and said compensating piston is connectable via a bore to said engine lubricating-oil circuit, with a spring-loaded valve being provided for blocking said bore.

3. A motor brake according to claim 1, wherein said at least one sensor is disposed across from the periphery of a sprocket of a flywheel or camshaft, with said at least one sensor having an inductively operating base and conveying voltage pulses to said control unit for processing, with said control unit actuating said solenoid valve.

4. A motor brake according to claim 1, which includes a second solenoid valve for a sequential switching-on of said brake.

* * * * *